US006231447B1

(12) United States Patent
Pelkey

(10) Patent No.: US 6,231,447 B1
(45) **Date of Patent: *May 15, 2001**

(54) PUSH BUTTON CONTROLLED POLICE BATON

(75) Inventor: Gary Lewis Pelkey, Rindge, NH (US)

(73) Assignee: Monadock Lifetime Products, Inc., Fitzwilliam, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,167

(22) Filed: Feb. 17, 1998

Related U.S. Application Data

(63) Continuation-in-part of application No. 08/785,028, filed on Jan. 17, 1997, now abandoned, which is a continuation of application No. 08/505,647, filed on Jul. 21, 1995, now abandoned.

(51) Int. Cl.[7] ..... F41B 15/02

(52) U.S. Cl. ..... 463/47.7; 403/368

(58) Field of Search ..... 403/325, 350, 403/367, 368, 377; 285/302; 463/47.2, 47.7; 135/68–70, 72, 75

(56) References Cited

U.S. PATENT DOCUMENTS

| | | | |
|---|---|---|---|
| D. 359,338 | 6/1995 | Starrett | D22/117 |
| 4,037,839 | 7/1977 | Nelson | 273/84 R |
| 4,982,960 | 1/1991 | David | 273/84 R |
| 5,036,873 | 8/1991 | Clayton | 135/75 |
| 5,160,140 | 11/1992 | Starrett | 273/84 |
| 5,320,348 | 6/1994 | Starrett | 273/84 |

*Primary Examiner*—William M. Pierce
(74) *Attorney, Agent, or Firm*—Ernest V. Linek; Banner & Witcoff, Ltd.

(57) ABSTRACT

An expandable police baton having tubular members, and a positive lock with an axially positioned cam release mechanism, which will maintain the members in an expanded telescoped position and then can release the locking mechanism by pushing a single button at the rear thereof so that the members can slide over one another to a collapsed position convenient for carrying the baton.

9 Claims, 3 Drawing Sheets

PUSH BUTTON CONTROLLED POLICE BATON

CROSS-REFERENCE TO RELATED APPLICATIONS

This application is a continuation-in-part of application Ser. No. 08/785,028, filed Jan. 17, 1997, now abandoned, which is a continuation of application Ser. No. 08/505,647, filed Jul. 21, 1995, now abandoned. The disclosures of these two applications are hereby incorporated herein by reference.

BACKGROUND OF THE INVENTION

This invention relates to a new and improved multi stage positive lock tubular expandable police baton. Police batons are used by police for crowd control and other police duties in place of the conventional wooden billy clubs. Expandable police batons are shown for example in U.S. Pat. Nos. 5,320,348 and 5,160,140.

The present invention provides a new and improved positive lock quick release police baton. In particular, the collapse of the extended sections into the larger tubular section is accomplished by the use of a single axially positioned push button mechanism.

SUMMARY OF THE INVENTION

This invention discloses a positive lock button release police baton preferably having three sections. Each section successively gets smaller in diameter with the smaller sections telescoping into and out of larger section in which they are slidably positioned.

In this baton, the middle section and the smaller inner section are moved outwardly until they are locked in place by locking means when each of the sections are fully extended. To cause the collapse of the sections into one another, a push button is depressed to cause an axially positioned cam member to disengage the lock holding the middle section to permit it to telescope into the larger end section. While the middle section is telescoping into said larger diameter end section, the lock holding the smaller section in place relative to said middle section is caused to disengage by a second camming surface of said cam member so that the smaller end section may telescope into said middle section.

The baton may be made out of metal such as steel, aluminum or any combination of same. The preferred steel is an alloy steel such as 4130. The steel may be hardened if desired to 38 to 44 Rockwell C using conventional heat treating process which produce martensite or bainite steel. The preferred aluminum is 6061-T6.

BRIEF DESCRIPTION OF THE DRAWINGS

The foregoing and other features and advantages of the present invention will be more fully understood from the following detailed description of an illustrative embodiment, taken in conjunction with the accompanying drawing in which.

DETAILED DESCRIPTION OF THE PREFERRED EMBODIMENTS

Figure 1:
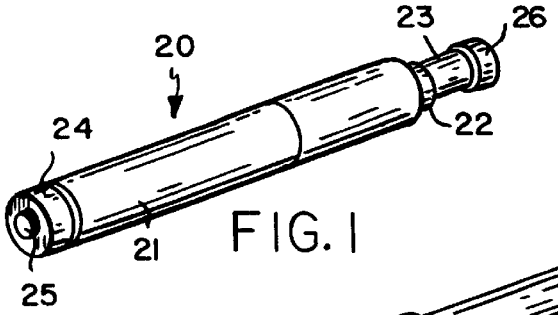
FIG. 1 is a perspective view showing the expandable police baton of this invention in a collapsed (closed) position.
Figure 2:
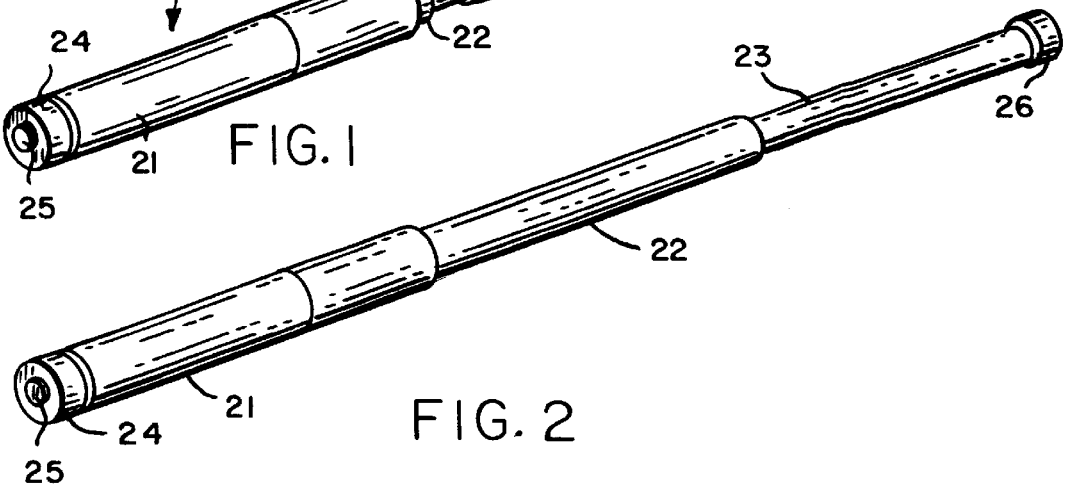
FIG. 2 is a perspective view of the police baton in an expanded (telescoping) position.

Reference now should be had to FIGS. 1 and 2 of the drawings. FIG. 1 shows the baton in a collapsed condition and FIG. 2 shows the baton in a fully extended (telescoping) condition. The baton 20 has a first (outer) tubular handle section 22, a second (middle) tubular section 24 and a third (inner) tubular section 26. A rear cap is provided at 28 which is preferably threaded to handle section 22. A tip is provided at 30 which has a threaded shaft 30*a* for screwing into threads of the third tubular section 26. A button 32 is provided at the base of the cap which is depressed by the user to permit the baton to collapse from the extended position as shown in FIG. 2 to the collapsed condition shown in FIG. 1.

Figure 3:
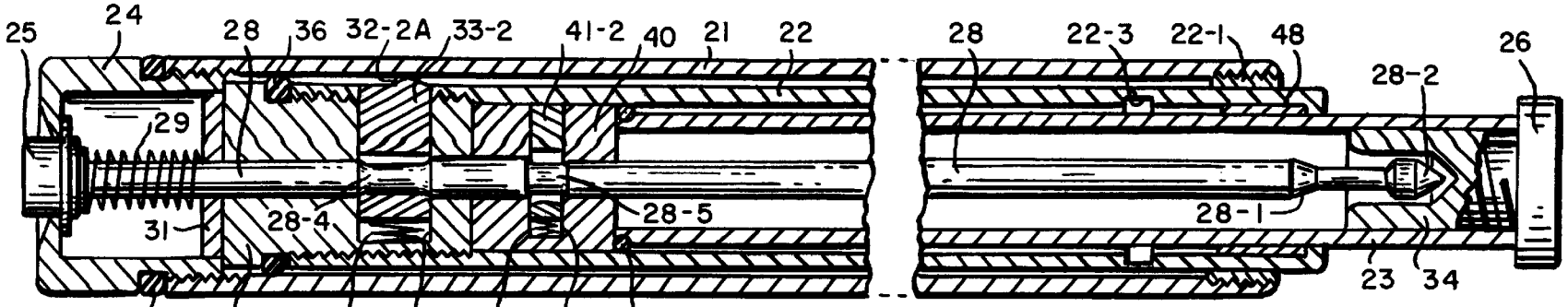
FIG. 3 is a sectional view (partially broken away) of the tubular police baton when in the collapsed position as shown in FIG. 1.

Reference should now be had to FIGS. 3 to 8 for a further description of the operation of the baton. FIG. 3 illustrates the first, second and third tubular sections in the collapsed position as shown in FIG. 1. In this position, the cam member (in the shape of a rod) 34 having two cam surfaces 36 and 38 are shown. The cam member 34 is fixedly coupled to the button 32 for movement therewith and a spring 40 and a platform 42 fixedly supported by the rear cap 28 (e.g., by welding, threading, press fit or bonding etc.) causes the spring to be in compression to force the button 32 to project outwardly from the rear cap 28. An O-ring 44 is provided between the threaded rear cap 28 and the first tubular section 22 as shown.

Threadedly coupled to the middle tubular section 24 is a first cylindrical block 46 supporting a locking mechanism including a cavity 48 in which there is positioned a slidably mounted pawl or pin 50 with a locking tip or edge 50' and a center bore 54 having two camming surfaces 56 and 58. A spring in the form of a resilient elastomeric block 60 is used to urge said pawl or pin 50 against the inside of the tubular member 22. An O-ring 62 is positioned between the first block 46 and the tube 24 and contacts the inside of tubular member 22.

A second block 64 is threadedly coupled to the third outer tubular section 26 and supports a second locking mechanism having a cavity 66, a pawl or pin 68 (in the form of a plate), a spring in the form of a resilient elastomeric block 70 and having a bore 72. An O-ring 74 is positioned between the second block 64 and the third tubular section 26.

The friction of the pawls or pins 50 and 68 provide resistance to maintain the baton in a collapsed configuration. A quick throw out (flick) of baton or slow passive draw, overcomes the hold back effect of this resistance, and also will allow the rod tip 30 to pass through the second block 64. A reduced diameter portion 76 is provided on the cam rod 34 for positioning and holding the locking pawl or pin 68 in place and thus the baton in a telescoping, extended position as shown in FIG. 4.

Figure 4:
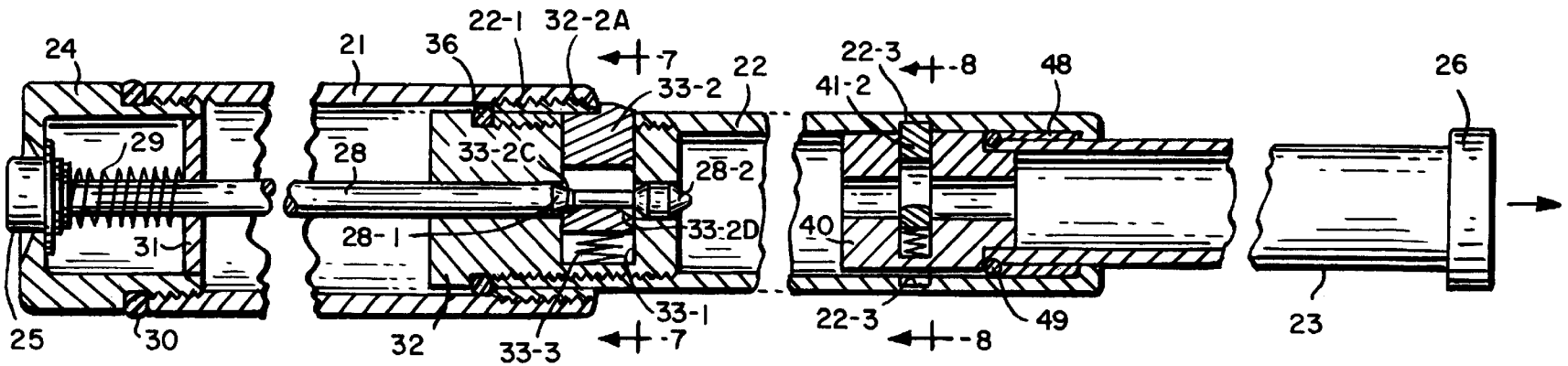
FIG. 4 is a sectional view (partially broken away) when the baton is in an expanded condition as shown in FIG. 2.

In FIG. 4, there is shown the baton in the fully telescoped (extended) position. In this position, the locking mechanism pawls or pins 50 and 68 are shown positioned in place to positively lock the baton for use. The pawls or pins 50 and 68 have portions 50', 68' which snap in place into grooves 50", 68" formed in the interiors of tubular members 22 and 24, respectively, under the bias of the spring members 40, 70.

The pawl or pin 68 is positioned in a cavity 65 formed in the interior of the second block 64. The third tubular section 26 moves against a metal bushing 78 e.g., of metal e.g., 4130 or 1020 steel which can be either threaded in as with bushing 80 or force fit and then having the end of the tubular member 24 peaned over to hold it in place as shown. This bushing may be threaded, bonded or welded. The bushings can also have a slip fit OD retained by rolling, swaging or crimping of the edge of the tubular members. An O-ring 74 is provided between the second cylindrical block 64 and the third tubular section 26.

Figure 5:
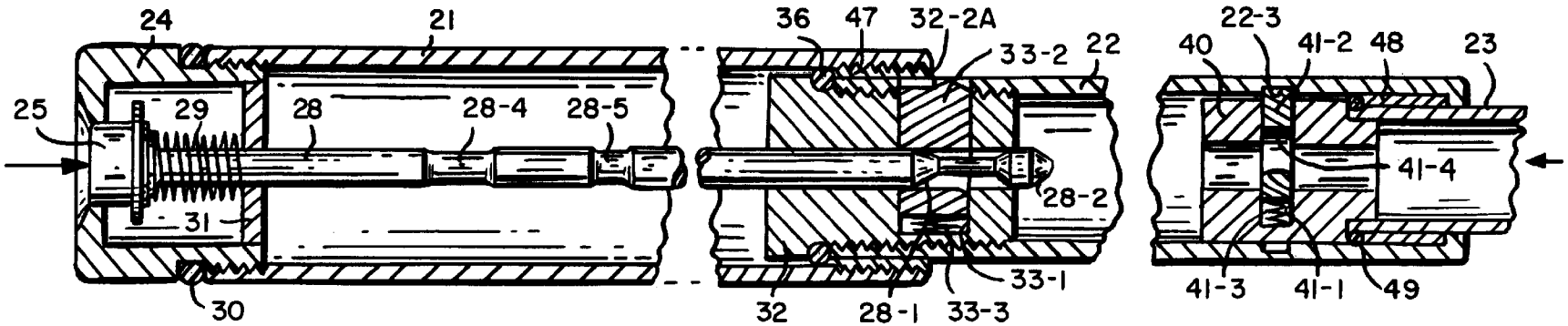
FIG. 5 is a sectional view (partially broken away) as the baton is being closed (collapsed) and the middle (intermediate) section moves into the larger tubular section.

FIG. 5 illustrates the collapsing of the baton and in particular, the button 32 being depressed (see arrow) which causes the camming surface 38 to engage the pin cam surface 56 of pawl or pin 50 to force the pawl or pin edge 50' to disengage from the groove 50" formed in tubular member 22. In this way, the baton section 24 can collapse into the section 22 by being pushed by the user to the left as depicted in FIG. 5.

Figure 6:
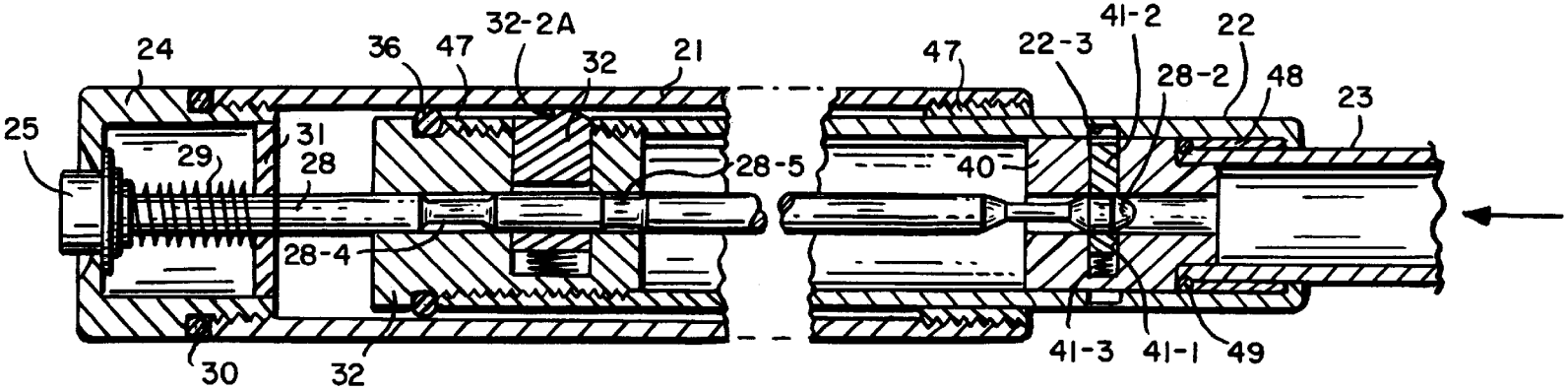
FIG. 6 is a sectional view similar to FIG. 5 with the smallest section also beginning to collapse into the intermediate section as its lock is moved in a direction to permit this to occur.
Figure 1:
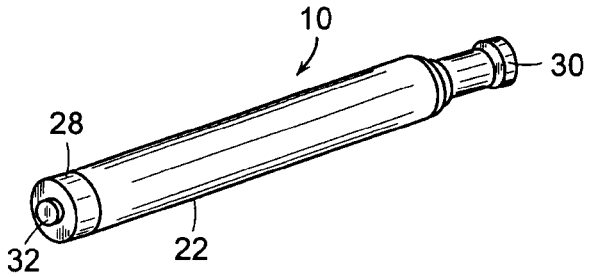
Figure 2:
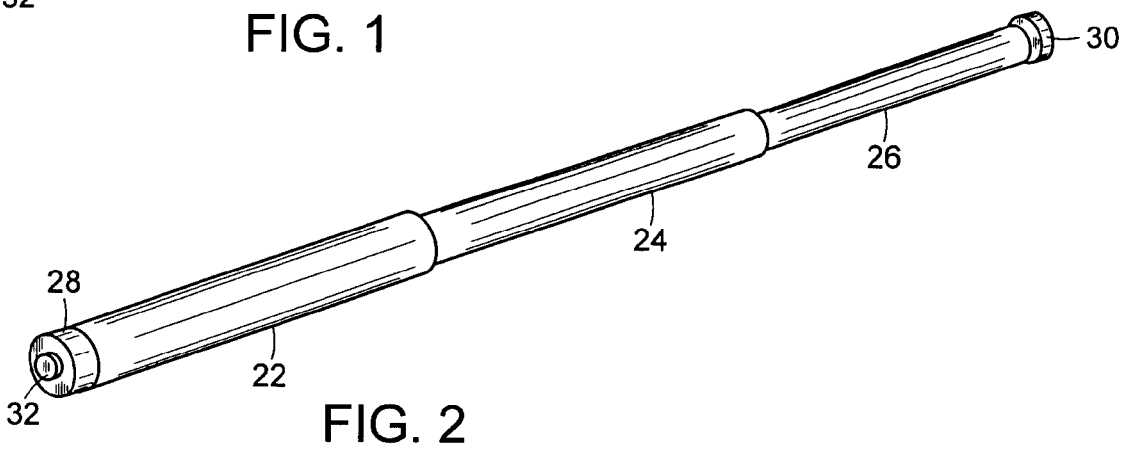
Figure 7:
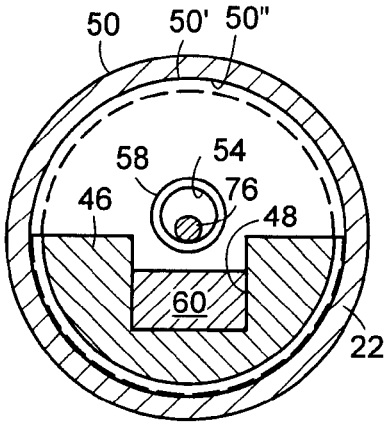
Figure 8:
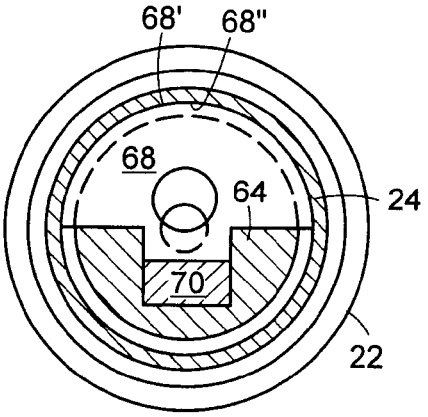
Figure 3:
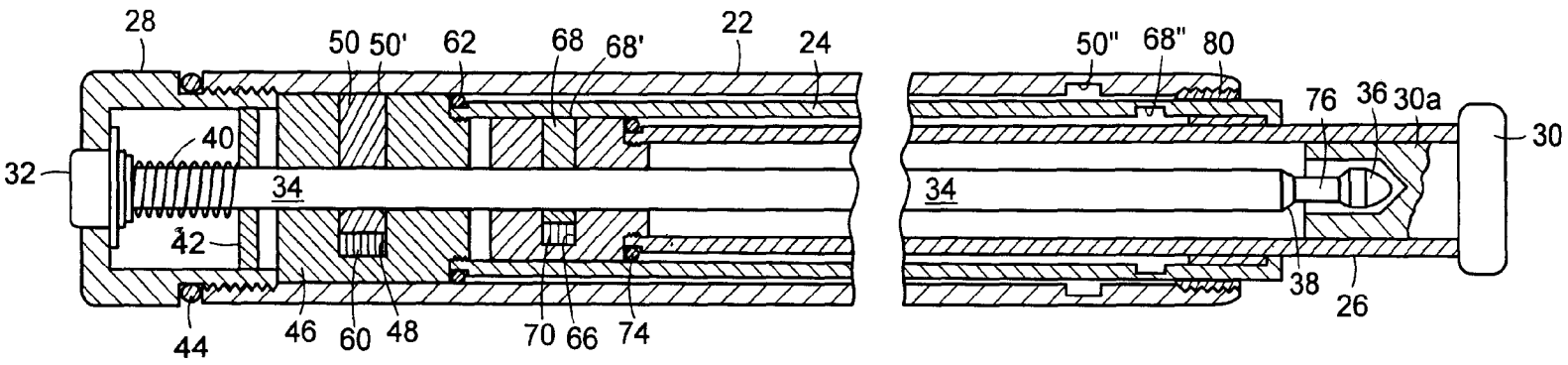
Figure 4:
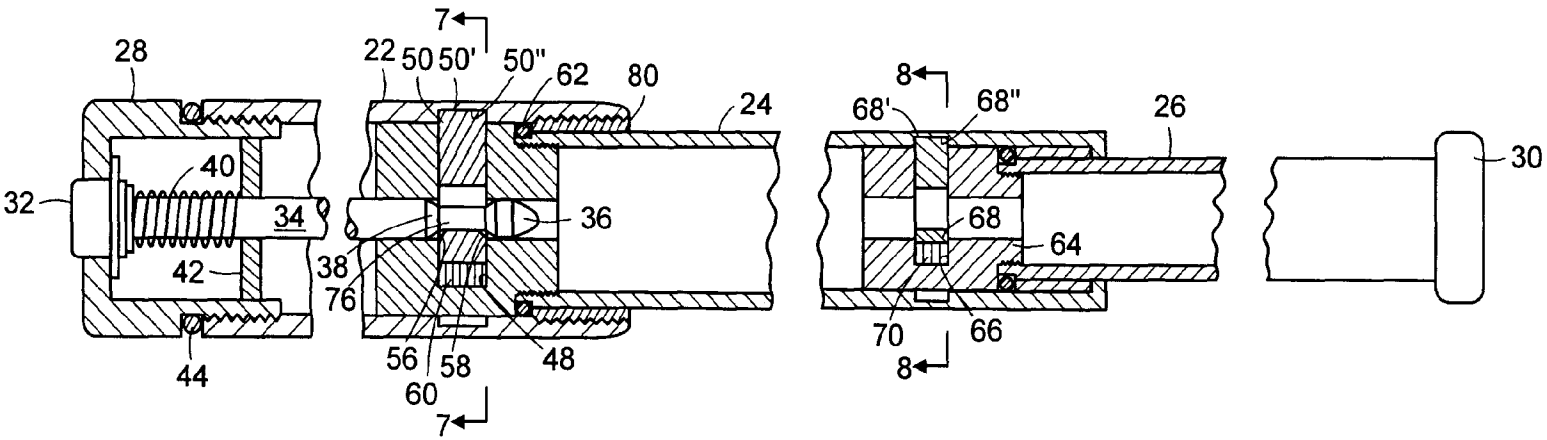
Figure 5:
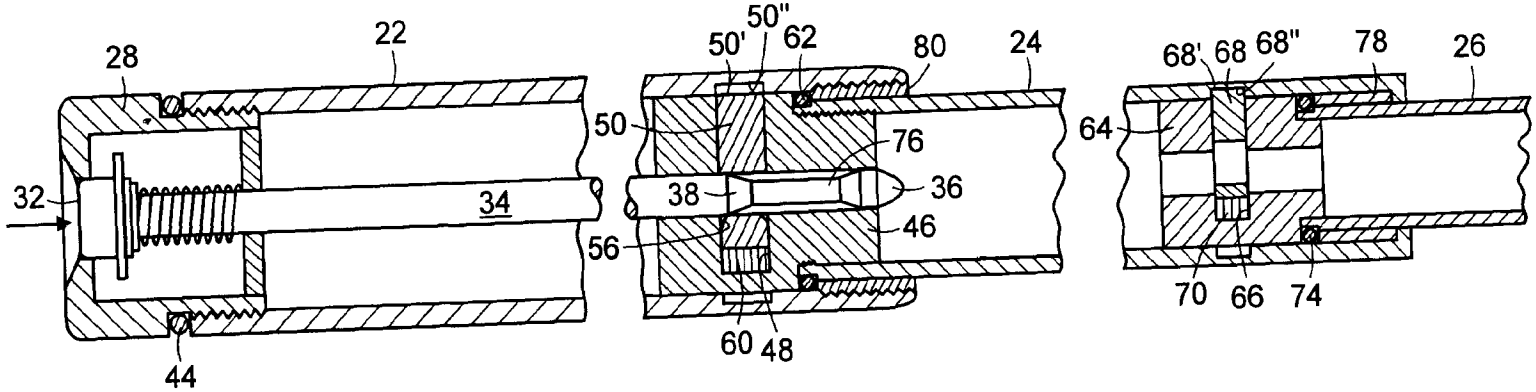
Figure 6:
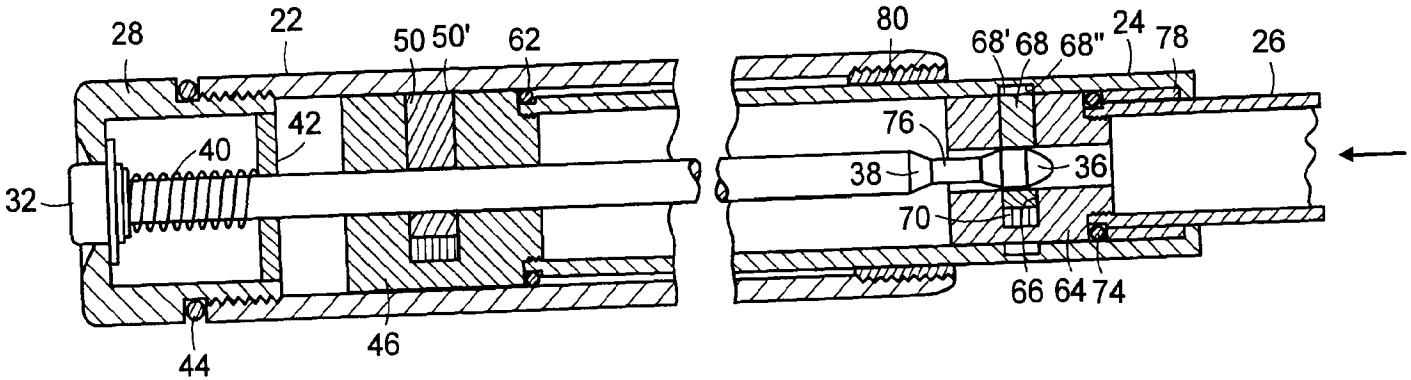

FIG. 6 illustrates the camming surface 36 engaging the pawl or pin 68 through bore 72, which results in the edge 68' to disengage it from the inner locking slot or groove 68" formed in tubular member 24. After the disengagement of pawl or pin 68, the third tubular section 26 can collapse into the middle tubular section 24, resulting in the collapsed configuration shown in FIG. 3.

Figure 7:
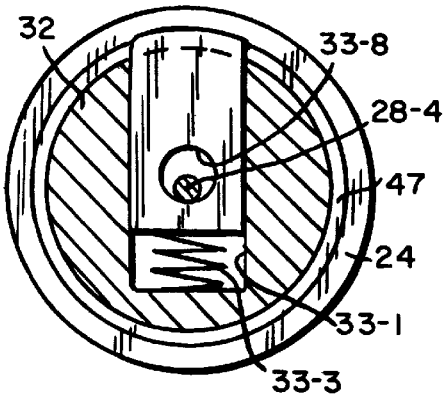
FIG. 7 is a sectional view taken along line 7—7 in FIG. 4.

FIG. 7 is a cross-sectional view of the first locking arrangement for maintaining the second tubular section 24 in an extended configuration vis-à-vis the first handle section 22, as shown in FIG. 4. The cylindrical block 46 has a cavity 48 holding a pawl or pin 50, which is spring biased by a resilient elastomeric element 60 in the upward direction as shown in the figure. The edge 50' of the pawl or pin 50 is urged against the interior surface of the tubular handle section 22, and into locking groove 50" formed on the interior wall of tubular section 22. When the baton is in the fully extended configuration, the reduced diameter portion 76 of the camming rod 34 resides within the center bore 54. Camming surface 58 is also shown.

Figure 8:
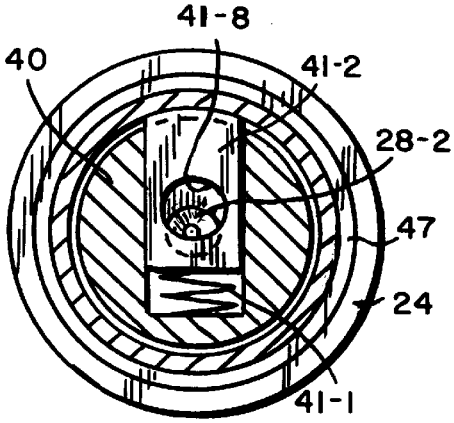
FIG. 8 is a sectional view taken along line 8—8 in FIG. 4.

FIG. 8 is a cross-sectional view of the second locking arrangement for maintaining the third tubular section 26 in an extended configuration vis-à-vis the second tubular section 24, also as shown in FIG. 4. The cylindrical block 64 has a cavity holding a pawl or pin 68, which is spring biased by a resilient elastomeric element 70 in the upward direction as shown in the figure. The edge 68' of the pawl or pin 68 is urged against the innterior surface of the tubular section 24, and into locking groove 68" formed on the interior wall of tubular section 24. When the baton is in the fully extended configuration, the camming rod 34 does not reside within the center bore of the pawl or pin. Camming surfaces, such as described with respect to the pawl or pin 50 as described above, may advantageously be provided to aid in the passage of the surfaces 36, 38 of the cam rod 34 therethrough during collapsing, as described above.

As may be observed, the present invention provides a new and improved positive lock mechanism which uses an axial cam push baton positive lock mechanism which makes for easy use by the police officer by merely pushing a single button to effect the collapse of the three section baton. It is also clear from the above that the mechanism herein is also applicable to two section batons.

Although the invention has been shown and described with respect to exemplary embodiments thereof, various other changes, additions and omissions in the form and detail thereof may be made therein without departing from the spirit and scope of the invention.

What is claimed is:

1. A telescopic, multi-stage, positive lock tubular police baton comprising:

(a) a first elongated tubular handle section;

(b) a second elongated tubular middle section, the middle section adapted to telescopingly reciprocate within the handle section;

(c) a third elongated tubular inner section adapted to telescopingly reciprocate within the middle section;

(d) a first spring loaded locking member contacting the handle tubular section and the middle tubular section, the first locking member being adapted to lock the handle and middle tubular members together in their fully extended position;

(e) a second spring loaded locking member contacting the middle tubular section and inner tubular section, the second locking member being adapted to lock the middle and inner tubular members together in their fully extended position;

(f) a release mechanism for disengagement of the three elongated tubular members from their fully extended position to a collapsed position, the release mechanism comprising a spring-loaded push-button activated multistage camming member comprising a push rod with a first and a second camming surface, the rod extending axially into the handle, middle and inner tubular sections, wherein the first camming surface is activated by the push button to disengage the first locking member contacting the handle tubular section and the middle section; and wherein the second camming surface is activated by the push button to disengage a second locking member contacting the middle tubular section and the inner tubular section.

2. The multi-stage positive lock tubular police baton of claim 1, wherein said first and second camming surfaces are adapted to operate in separate stages to separately disengage said first and said second locking members.

3. The multi-stage positive lock tubular police baton of claim 2, wherein at least one of said baton tubular members is made from metal tubing.

4. The multi-stage positive lock tubular police baton of claim 3, wherein at least one of said baton tubular members is made from steel tubing.

5. The multi-stage positive lock tubular police baton of claim 4, wherein the steel tubing is an alloy steel.

6. The multi-stage positive lock tubular police baton of claim 5, wherein the steel alloy is 4130 steel.

7. The multi-stage positive lock tubular police baton of claim 6, wherein the steel is hardened to 38 to 44 on the Rockwell C Scale.

8. The multi-stage positive lock tubular police baton of claim 1, wherein at least one of said baton tubular members is made from aluminum tubing.

9. The multi-stage positive lock tubular police baton of claim 8, wherein the aluminum is 6061-T6.

* * * * *

UNITED STATES PATENT AND TRADEMARK OFFICE

CERTIFICATE OF CORRECTION

PATENT NO. : 6,231,447 B1
APPLICATION NO. : 09/024167
DATED : May 15, 2001
INVENTOR(S) : Gary Lewis Pelkey It is certified that error appears in the above-identified patent and that said Letters Patent is hereby corrected as shown below:

The Title Page should be deleted and substitute therefore the attached Title Page.

Delete drawing sheets 1-3 and substitute therefore the drawing sheets, consisting of FIGS. 1-8 as shown on the attached pages.

Signed and Sealed this

Seventeenth Day of October, 2006

JON W. DUDAS
*Director of the United States Patent and Trademark Office*

(12) United States Patent
Pelkey

(10) Patent No.: US 6,231,447 B1
(45) **Date of Patent: *May 15, 2001**

(54) PUSH BUTTON CONTROLLED POLICE BATON

(75) Inventor: Gary Lewis Pelkey, Rindge, NH (US)

(73) Assignee: Monadock Lifetime Products, Inc., Fitzwilliam, NH (US)

(*) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,167

(22) Filed: Feb. 17, 1998

Related U.S. Application Data

(63) Continuation-in-part of application No. 08/785,028, filed on Jan. 17, 1997, now abandoned, which is a continuation of application No. 08/505,647, filed on Jul. 21, 1995, now abandoned.

(51) Int. Cl.[7] ..... F41B 15/02

(52) U.S. Cl. ..... 463/47.7; 403/368

(58) Field of Search ..... 403/325, 350, 403/367, 368, 377; 285/302; 463/47.2, 47.7; 135/68–70, 72, 75

(56) References Cited

U.S. PATENT DOCUMENTS

| | | | |
|---|---|---|---|
| D. 359,338 | 6/1995 | Starrett | D22/117 |
| 4,037,839 | 7/1977 | Nelson | 273/84 R |
| 4,982,960 | 1/1991 | David | 273/84 R |
| 5,036,873 | 8/1991 | Clayton | 135/75 |
| 5,160,140 | 11/1992 | Starrett | 273/84 |
| 5,320,348 | 6/1994 | Starrett | 273/84 |

*Primary Examiner*—William M. Pierce
(74) *Attorney, Agent, or Firm*—Ernest V. Linek; Banner & Witcoff, Ltd.

(57) ABSTRACT

An expandable police baton having tubular members, and a positive lock with an axially positioned cam release mechanism, which will maintain the members in an expanded telescoped position and then can release the locking mechanism by pushing a single button at the rear thereof so that the members can slide over one another to a collapsed position convenient for carrying the baton.

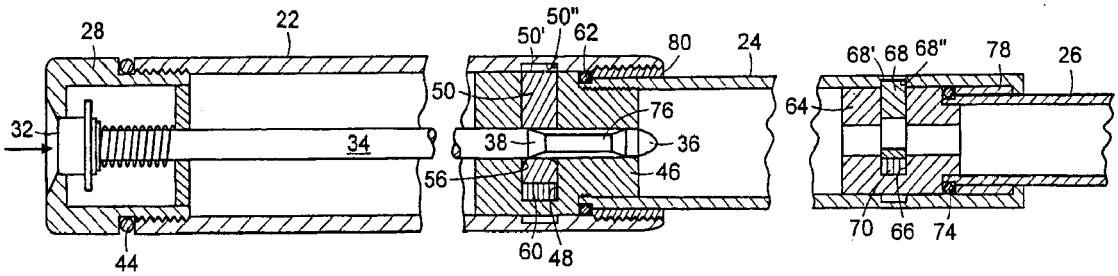

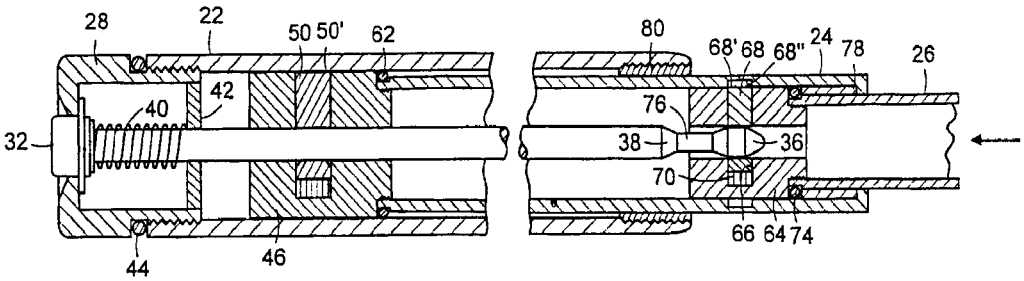

9 Claims, 3 Drawing Sheets